US006463674B1

(12) United States Patent
Meyers et al.

(10) Patent No.: US 6,463,674 B1
(45) Date of Patent: Oct. 15, 2002

(54) HOT AIR IMPINGEMENT DRYING SYSTEM FOR INKJET IMAGES

(75) Inventors: John J. Meyers, Penfield, NY (US); Roger G. Leighton, Rochester, NY (US); Dawn M. Api, Rochester, NY (US); Gerald A. Domoto, Briarcliff Manor, NY (US); Elias Panides, Whitestone, NY (US); Narayan V. Deshpande, Penfield, NY (US); Andrew W. Hays, Fairport, NY (US); S. Warren Lohr, Rogue Bluffs, ME (US); Thomas N. Taylor, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/721,736

(22) Filed: Nov. 27, 2000

(51) Int. Cl.[7] ..... F26B 5/06

(52) U.S. Cl. ..... 34/304; 34/418; 34/419; 34/420; 34/611; 34/612; 34/524; 34/523

(58) Field of Search ..... 34/304, 418, 419, 34/420, 611, 612, 524, 523

(56) References Cited

U.S. PATENT DOCUMENTS

| | | | | | |
|---|---|---|---|---|---|
| 4,903,082 | A | * | 2/1990 | Dyer et al. | 355/290 |
| 5,396,270 | A | * | 3/1995 | Gooray et al. | 346/25 |
| 5,784,679 | A | * | 7/1998 | Schlueter, Jr. et al. | 399/335 |
| 6,071,368 | A | * | 6/2000 | Boyd et al. | 156/240 |
| 6,238,046 | B1 | * | 5/2001 | Donahue | 347/102 |
| 6,296,901 | B1 | * | 10/2001 | Boyd et al. | 427/148 |

* cited by examiner

*Primary Examiner*—William C. Doerrler
*Assistant Examiner*—Mark Shulman
(74) *Attorney, Agent, or Firm*—Oliff & Berridge, PLC

(57) ABSTRACT

A dryer uses a two-phase drying system having a brief water condensation interval, followed by impinging parallel laminar recirculating hot air jets which impinge on wet ink to increase the copy rate of inkjet printing and to increase the quality of the printed image.

43 Claims, 6 Drawing Sheets

HOT AIR IMPINGEMENT DRYING SYSTEM FOR INKJET IMAGES

BACKGROUND OF THE INVENTION

1. Field of the Invention

This invention concerns a system and methods usable to dry liquid ink images.

2. Description of Related Art

Inkjet printing quality, such as, for example, uniformity of ink density, contrast of the ink with respect to the paper on which the ink is placed, lack of smearing, etc., is generally highly dependent upon the quality of the recording medium on which the ink is placed and the surface tension of the ink. Inkjet printers that use high surface tension, and therefore slow penetrating inks, including water soluble inks, require that care be taken to avoid smudging of the ink on the recording medium too soon after the ink is printed and to avoid offset problems, i.e., transfer of the ink onto an object that comes in contact with the recording medium, such as, for example, another piece of paper or a human hand. In general, it is desirable to be able to actively dry an inkjet printed image sufficiently so that the image bearing recording medium may be contacted by another object without smudging within 3 seconds after the image has been printed. Drying the printed ink is often accomplished naturally, i.e., by ambient air drying, but active drying is also used, e.g., drying with a source of heat such as, for example, a radiant heater, a microwave heater, or hot gas.

For example, U.S. Pat. No. 4,340,893 to Ort describes a scanning inkjet printer with an ink drying apparatus on the carriage where the drying apparatus includes a dryer body 40 that directs unheated or heated air onto the printed ink, and even provides for re-circulation of the air. The humidity of the air may be monitored to obtain an indication of the drying capability of the system.

U.S. Pat. No. 4,970,528 to Beaufort et al. discloses a uniform heat flux dryer system and method for an inkjet printer using an infrared bulb.

U.S. Pat. No. 5,349,905 to Taylor et al. teaches using a microwave dryer to dry a thermal inkjet printed image.

U.S. Pat. No. 5,502,475 to Kaburagi et al. teaches using an electrical resistance heater with a temperature control unit to dry an inkjet printed image.

U.S. Pat. No. 5,631,685 to Gooray et al. teaches a microwave dryer for an inkjet printer.

U.S. Pat. Nos. 5,713,138, 5,901,462 and 5,953,833 to Rudd teach a dryer for wet coatings, including printing inks, using re-circulated heated and pressurized air which impinges on the wet coated recording medium, and the use of energy emitters such as radiant heating elements.

U.S. Pat. No. 4,566,014 to Paranjpe et al. discloses a method of sheet feeding to enhance dryer operation and which discloses different types of dryers for ink drops on sheets, including a radio frequency dryer and a drying system employing dried and heated air blown at high velocity onto a sheet of paper to accelerate drying of the ink deposited on the sheet of paper.

U.S. Pat. No. 5,214,442 to Roller discloses an adaptive dryer which varies the feed rate of inkjet printed pages through a dryer and the temperature of the dryer, and discloses a microwave dryer and a convective dryer.

U.S. Pat. No. 5,140,377 to Lewis et al. discloses a xerographic printing apparatus in which toner material is thermally fused and fixed onto a surface of a copy sheet by condensing water vapor on the surface of a copy sheet.

SUMMARY OF THE INVENTION

The two-phase drying systems and methods according to this invention improve the quality of liquid ink printing with high surface tension/slow penetrating inks, such as water soluble inks, on different media, including paper.

This invention provides systems and methods for rapidly drying liquid ink that use an active two-phase drying system. This invention separately provides systems and methods for actively drying liquid ink that use a brief water condensation interval to heat the liquid ink and recording medium.

This invention further provides systems and methods for actively drying liquid ink that follow the water condensation interval with a period of relatively low velocity laminar air flow.

This invention next separately provides systems and methods for actively drying liquid ink following the laminar air flow drying that use a short period of modulated re-circulating hot air flows impinging on the wet ink. This results in the ink being dried in a rapid continuous manner equal to the printing rate so that no subsequent drying period is needed.

Various exemplary embodiments of a system according to this invention include a dryer which has a moist air circulating system. In various exemplary embodiments, the moist air first comes into contact with the liquid ink in a relatively low pressure laminar flow region according to this invention. In various exemplary embodiments, the liquid ink is then placed in a second higher pressure turbulent region in which the moist re-circulated heated air is driven against the liquid ink. In various exemplary embodiments, the moist heated air is driven by a fan and contains air impingement plates, one for an air heater plate and one to direct heated air against the liquid ink. In various exemplary embodiments, a thermally insulating enclosure is provided for the dryer. The impingement plates have openings, including holes and/or slits arranged in some pattern, that provide desired air flow conditions. The air impingement plates increase the velocity of the moist air pattern with respect to air being blown by an air re-circulatory element, such as, for example, a fan over the velocity that would occur without the air impingement plates. This increased air velocity increases the heat transfer coefficient in the dryer, improves the efficiency of the heating of the air in the dryer by the heater plate, and speeds up removal of moisture from the recording medium on which the liquid ink has been printed.

In various exemplary embodiments of the systems and methods according to this invention, drying the liquid ink occurs in two stages. The dew point, or condensation temperature, of the moist air circulating in the dryer is built up to, and maintained at, a value which is well above the temperature of the incoming recording medium and the liquid ink. As a result, for a short period of time, until the temperatures of the recording medium and liquid ink increase in the dryer, a small amount of moisture is condensed onto the surface of the incoming ink and the recording medium on which the ink is deposited. The heat liberated during moisture condensation heats up the liquid ink and the recording medium on which it is deposited to the dew point temperature of the re-circulated drying air. This results in restricting further moisture condensation and allowing the drying process to begin within the laminar flow and impingement flow air drying sections. As a result of the initial moisture condensation, the ink image is uniformly heated and its viscosity and surface tension are lowered, whereby the quality of the printing or imaging is improved in many aspects, including the uniformity of ink distribution and ink density, and contrast between the ink and the recording medium. In the laminar flow and impingement flow air drying sections, the liquid ink is rapidly dried.

In various exemplary embodiments of the systems and methods of this invention, the distance between the heating element and its impingement plate remains constant. The recording medium and its air flow plate also remains substantially constant as the recording medium moves through the laminar flow dryer. In various other exemplary embodiments of this invention, in the turbulent flow region, the spacing between the air impingement plate and the recording medium can either remain constant or it can vary as the recording medium moves through the dryer. In various exemplary embodiments, when the spacing changes, the spacing or gap between that air impingement plate and the recording medium is greatest at the entrance to the turbulent impingement plate dryer and is smallest at the exit from the turbulent dryer. In various exemplary embodiments of the systems and methods according to this invention, the moist heated air is brought into contact with the back side of the recording medium, (i.e., the side of the recording medium on which the liquid ink is not deposited) employing an impingement flow plate to produce turbulent flow and also the heated moist air is brought into contact with the front side of the recording medium employing a flow plate to produce laminar air flow.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Figure 1:
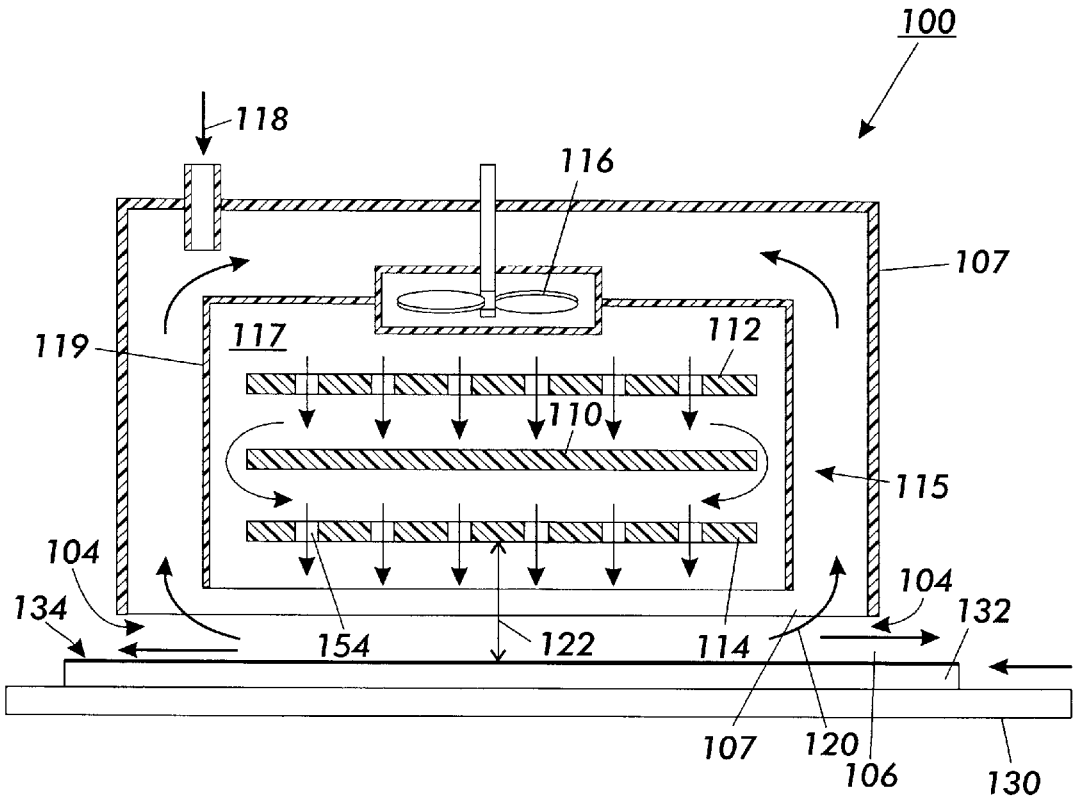
FIG. 1 is a schematic side view of a first embodiment of a system for drying liquid ink according to this invention.

FIG. 1 shows a first exemplary embodiment of a dryer 100 that incorporates the systems and methods for drying liquid ink according to this invention. As shown in FIG. 1, the dryer 100 has a fan 116 mounted on a shaft to circulate and re-circulate air from an outer chamber 115 through an inner chamber 117. The inner chamber 117 contains an upper impingement plate 112 and a lower impingement plate 114, and a heating element 110. The inner chamber 117 and the outer chamber 115 are separated by a frame element 119. The dryer 100 has an opening 118 through which makeup air enters the outer chamber 115. Some of the air which has been re-circulated by the fan 116 is shown exiting the dryer through a gap 104 between an outer housing 107 of the dryer 100 and a platen 130, the mass flow of this air equals the mass flow of makeup air entering the opening 118.

As shown in FIG. 1, an image recording medium 132, such as, for example, a sheet of paper, a textile, a transparency or the like, contains a portion of liquid ink 134 placed thereon by a printer, such as, for example, an inkjet printer (not shown). The air impingement plates 112 and 114, which are located in the inner chamber 117 have openings 154 in the form of holes or slits, or combinations of holes or slits. The openings 154 are, in various exemplary embodiments, arranged in a geometrical pattern that provide desired air flow conditions. The higher the velocity of the heated air jets, the greater the transfer coefficient of heat from the air to the recording medium 132 and ink 134 and the greater the amount of moisture that can be removed from the surface of the recording medium 132 and the ink 134. Likewise, the higher the velocity of the air, the greater the heat transfer coefficient and thereby the heating of air by the heating element 110.

In various exemplary embodiments of the dryer 100 according to this invention, the ink 134 can be heated and then dried on the recording medium 132, in two stages or phases. In the first stage, some amount of moisture is deposited on the recording medium 132 and on the ink 134 which has been printed onto the recording medium 132 and it uniformly heats the ink up to the dewpoint temperature of the drying air. In the second stage, drying occurs and sufficient moisture is removed by the drying air from the ink 134 and the recording medium 132 to dry the ink 134. The second stage can be further broken down into two sub stages. The first is a relatively laminar flow stage which gently and uniformly semi-dries the ink 134. In this first sub stage, the portion 120 of the dryer 100 in which this occurs is located between an entrance 106 and a boundary 107 between the outer chamber 115 and the inner chamber 117. The flow of air in this laminar flow region 120 (FIG. 1) is selected to have a relatively low velocity so that the liquid ink 134 on the recording medium 132 is not blown across the surface of the recording medium and is relatively uniformly heated across the surface of the recording medium 132. By the time the recording medium 132 and the liquid ink 134 reaches the inner chamber 117 (FIG. 1), in which the air pressure and flow velocity is significantly higher than in the laminar flow region 120, the ink 134 has penetrated into the recording medium 132 and does not puddle or sit on top of the recording medium 132. In this situation, the stronger air flows and turbulence can more effectively dry not only the recording medium 132 but also the liquid ink 134 without blowing any ink across the surface of the recording medium 132 because the liquid ink 134 is more viscous and also has already penetrated the recording medium, and needs only to be dried.

In the various exemplary embodiments of the systems and methods according to this invention, the air circulated and re-circulated by the fan 116 should be moist. If the air is initially dry, moisture must be added to the dry air. However, as the air removes moisture from the liquid ink 134 and the recording medium 132, the air circulating through the dryer 100 becomes moist and may also pick up contaminants. In the exemplary embodiment of the dryer 100 shown in FIG. 1, enough air is exhausted via the gaps 104 between the outer housing 119 and the platen 130 to remove the drying moisture load and any contaminates. As a result, air has to be added to make up for the moist and contaminated air that has been exhausted. Moisture may be added to the make-up air, which enters through the opening 118 into the outer chamber 115, if the make-up air lowers the moisture content of the air in the dryer 100 below a desired dewpoint level, such as at start-up, for example.

Figure 2:
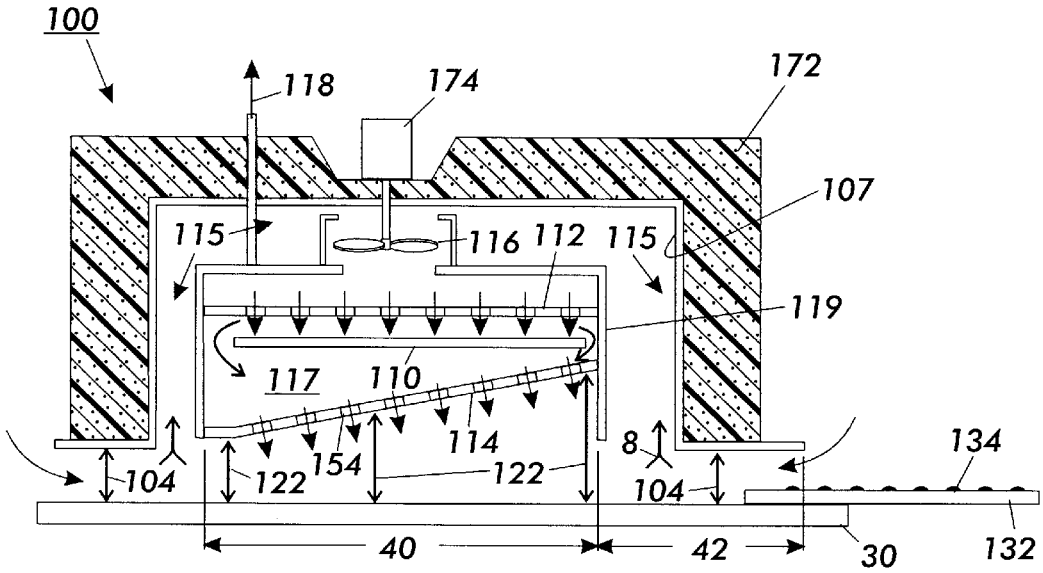
FIG. 2 is a schematic side view of a second embodiment of a system for drying liquid ink according to this invention.

FIG. 2 shows a second exemplary embodiment of the dryer 100 that incorporates the systems and methods for drying liquid ink according to this invention. As shown in FIG. 2, the gap 122 between the lower impingement plate 114 and the image bearing recording medium 132 or platen 130 tapers from a relatively large value where the image bearing recording medium 132 enters the dryer 100 to a smaller value where the image bearing recording medium 132 leaves the dryer 100. It is to be understood, however, that if desired to provide complete area coverage by the impinging air jets the dryer 100 may be oscillated in an orbital plane, laterally or in other fashion, relative to the recording medium 132 or vice versa.

As a result of this varying gap 122, a relatively low velocity portion of the modulated impingement air drying section 40 is created to dry the liquid ink 134 and its recording medium 132 should some liquid ink 134 still be mobile on top of the recording medium 132 when the recording medium enters the modulated impingement air section 40. The air impingement plate 114 is located closer to the path of the recording medium 132 and platen 130 near the end of the dryer 100 where the recording medium 132 exits the dryer 100, so that relatively higher velocity modulated air flow and higher heat transfer occurs where the ink is immobile as the recording medium 132 passes toward the exit end of the dryer 100. The air flow velocity drops significantly, again, however, outside of the inner chamber, i.e., when the recording medium 132 reaches the outer chamber portion 115 adjacent the exit end of the dryer 100. This tapered or angled orientation of the lower air impingement plate 114 tends to reduce or minimize creation of extraneous drying artifact formation on the recording medium 132.

In the exemplary embodiment shown in FIG. 2, the drying makeup and exhaust configuration is different than in the exemplary embodiment shown in FIG. 1. In the exemplary embodiment of FIG. 1, the make-up air enters the dryer 100 through orifice 118 and enters the dryer 100 in the relatively low pressure outer chamber 115. The make up air exits the dryer 100 through the gap 104 between the dryer 100 and platen 130. However, in the exemplary embodiment of FIG. 2, make-up air is drawn into the dryer 100 through the gap 104 between the dryer 100 and the platen 130 and is exhausted through orifice 118 from the relatively high pressure inner chamber 117, which is closer to the fan 116. In the exemplary embodiments of either FIG. 1 or FIG. 2, the drying air is re-circulated with a controlled amount of make-up air and a corresponding amount of exhaust air. Due to recirculation, the moisture content of the recirculated air is increased and achieves a particular dew point temperature, which is well above both the temperature of the entering recording medium 132 and ink 134, and of the entering makeup air. As a result, for a short period of time, a small amount of moisture is condensed onto the incoming liquid ink 134 and surface of recording medium 132, both of which are at a temperature well below the dew point temperature of the moist air being recirculated in the dryer. It appears that the heat liberated by the moisture which condensed on the ink 134 and the surface of recording medium 132 immediately and uniformly heats up the ink 134 and the surface of recording medium 132 to the air dew point temperature, thereby reducing the likelihood of further moisture condensation on the ink 134 and the surface of recording medium 132 and permits the process of drying the printed image to begin. Following the brief moisture condensation period, humid air with a relatively uniform temperature further contacts the printed image in two drying sections (42, 40).

The design of the first section 42 of the dryer creates a relatively low and uniform heat transfer coefficient with a relatively uniform heat transfer temperature differential which results in a relatively slow, uniform recording medium 132 surface drying profile. The FIG. 2 exemplary embodiment of dryer 100 next has an impingement drying section 40 configured with a sloped lower impingement plate 114 which provides a relatively large gap 122 between the lower air impingement plate 114 and the recording medium 132 or platen 130 at the end of the dryer 100 where the recording medium 132 is fed into the dryer 100 and which gradually decreases to provide less of a gap 122 between the air impingement plate 114 and platen 130 toward the exit end of dryer 100. This results in controlling the drying intensity from a relatively low rate at the feed end impingement section 40 of dryer 100 to a relatively high rate at the exit end of impingement section 40 of dryer 100. Further control of air drying intensity is offered and provided by the gap spacing 104 between the impingement plate 114 and the recording medium 132. For indexed recording medium transport systems, found in many inkjet printers, the heat transfer coefficient in the impingement drying section 117 can be modulated in a stepwise fashion. Each step or drying zone can be one indexed swath wide and provide relatively uniform drying over a swath during the inkjet printer carriage scan time. Stepped drying zones may be implemented using a lower air impingement plate 114 with a stepped cross section in which the width of each step corresponds to one or more indexed positions of the ink recording medium 132 which moves in a discontinuous manner relative to the air impingement plate 114. The steps of the stepped air impingement plate 114 may be parallel with the platen 130 or the recording medium 132 or the steps may be tilted at an angle other than 180 degrees with respect to the plane of the platen 130 or the path of the recording medium 132. The air impingement plate 114 may be either stepped or planar or have a combination of both features, and may be parallel to, or tilted at a non-parallel angle to the plane of the recording medium 132 or platen 130. These exemplary embodiments of air impingement plates 112 and 114 may be used in any of the exemplary embodiments of dryer 100, i.e., in the embodiments shown in FIGS. 1–3 and 8. A further improvement in uniformity of drying and a further reduction in the chance of introducing drying artifacts can be achieved by moving the dryer 100 or the air impingement jets 114 in an orbital, lateral or other fashion relative to the image to provide a time-averaged uniform heat transfer profile.

The air which is exhausted from the dryer 100 through orifice 118 may be sized to easily accommodate its disposal.

For example, a certain percentage, say 10 percent, of the air which is circulated, may be exhausted in this manner. By exhausting the moist and possibly contaminated air through a single orifice 118, it is relatively easy to accommodate its treatment or disposal. For example, the exhausted air may be mixed with room air to lower its dewpoint and then be exhausted without fog formation outside of a room in which the dryer 100 is located, or it may be passed through one or more filters to remove contaminants plus a condenser to remove water before discharge back into the room. As an alternative, air which is exhausted may be passed through a moisture condenser and carbon contaminate removal filters so that it may be returned to the machine operational room area to conserve building heating load.

The air impingement plate 112 is used to inject the re-circulated air against the heating element 110 to provide a relatively high heat transfer coefficient, which reduces the operating temperature required of heating element 110, and to minimize the heat transfer area and, thus, size of heating element 110. The heat load of heating element 110 has to provide the heat needed to evaporate all of the initial moisture in the liquid ink 134 plus some of the initial moisture equilibrium moisture content of the printed image bearing surface of recording medium 132, e.g., paper, system heat losses, and to heat the makeup air from its supply temperature to the operating temperature of the dryer 100.

The air impingement plates 112 and 114 employ relatively small diameter holes or relatively narrow width slots, or both, 154. The air impingement plate openings 154 which form the air jets are arranged in various patterns, including square or staggered-row patterns or chevron row patterns. In an exemplary embodiment using impingement jet holes 154, the spacing between holes was about four times the diameter of the holes 154. In an exemplary embodiment using openings 154 in the form of slots, the spacing between the slots 154 was about four times the slot width in the recording medium 132 feed direction, and the length of each slot 154 was about 100 times the slot width running in the direction across the feed direction of the recording medium 132. The total open area of the holes 154 and/or slots 154 and the delivered volumetric air flow rates are expected to provide an air impingement jet velocity of about 5.55 meters per second, i.e., about 18.2 feet per second. In exemplary embodiments according to the invention, the holes 154 or slots 154 were provided with rounded edges to lower flow pressure loss and to provide a relatively wider air jet flow distribution profile.

The air plenum system 115 is provided with thermal insulation 172 to reduce loss of heat from the dryer 100, to reduce the temperature of the outside surface of the dryer 100 in order to reduce the danger and possibility of personnel bums and to save power. The insulation 172 is chosen to provide attenuation and damping of sound and noise generated by the recirculation air fan 116. The recirculation air fan 116 has a motor element 174 mounted outside of the dryer 100, while the drive shaft and blade assembly of the fan 116 is located inside of the dryer 100. To further reduce noise generated by the fan 116, the combined configuration volume of the air return together with hole or slot 154 size and pattern is designed to operate as a low pass sound filter tuned to the sound frequency generated by the fan 116. Principles of using a resonant type sound cancellation structure to reduce noise are illustrated in U.S. Pat. No. 2,808,122 of inventor John J. Meyers, the disclosure of which is incorporated herein by reference. In another illustrative embodiment, the electrical motor 174 of the fan 116 may be inside of the dryer plenum 117 to use its electrical power to help heat the air. However, this requires a motor 174 design (materials and lubrication) which will tolerate the temperature in the dryer, which is typically 150° C. or higher. Commercial motors are available to operate at high temperatures but are relatively expensive. If cost is a factor, the motor 174 can be placed outside of the dryer, as shown, by employing a drive shaft extension, as shown in FIG. 1 and FIG. 2.

A simplified breadboard unit of this type as shown in FIG. 2 was constructed as follows. The air impingement plate 114 was 5.25 inches long and 10 inches wide with 0.76 mm (0.03 inch) diameter holes 154 arranged in a square pattern on 3.17 mm (0.125 inch) centers. The holes 154 had rounded entrance edges to lower flow pressure loss and to provide a relatively wide air jet distribution profile. The feed-end laminar flow drying section 42 was 8.9 cm (3.5 inches) long. The spacing between the sloped air impingement plate 114 and the recording medium 132 decreased uniformly from 12 mm at the feed-end to 6 mm at the exit end of dryer 100 and was 13.34 cm (5.25 inches) long. A room temperature (22° C.) air supply that was passed over an electrical heating wire plate 110, mounted in the heater plenum 117, successfully heated the air from room temperature to the selected drying temperature. The air recirculation feature was not implemented, but the fan 116 delivered drying air from the room and the drying air was humidified to the equivalent of recirculated moist air using a source of steam, by admitting the steam into the heater plenum 117 through opening 118. A venturi meter (not shown) measured the supply air flow and the steam flow was controlled by evaporating a measured flow rate of water and passing this into the plenum 117. The plenum area 117 was thermally insulated with 1 inch of fused silica. The selected air flow rate was controlled by a voltage rheostat (not shown) located on the fan motor 174 and the selected temperature of the drying air was controlled by a voltage rheostat (not shown) located on the electrical heating element plate 110.

The dryer breadboard was located immediately after a computer controlled ink print head station (not shown). The printed image was indexed through the dryer 100 in one second steps of 1.7 inches index (0.12 seconds travel and 0.88 seconds stationary) providing approximately 3 seconds of impinged air drying time or alternatively in one second steps of 0.85 inch providing about 6 seconds of impinged air drying time. After the drying step, the dried inkjet image was contacted with a clean sheet of paper and passed under a pinch roller (not shown) to subjectively evaluate drying by any offset of ink onto the clean paper. An aluminum paper support platen with slots to a vacuum source was used to hold down the recording medium 132, which was paper.

The exemplary embodiments of the air impingement plates 112 and 114 and heating element 110 and plenums 115 and 117 and opening 118, and of fan 116 described with respect to the exemplary embodiment of FIG. 2 and the simplified breadboard version thereof may be used in any of the exemplary embodiments of the dryers 100 of this invention.

Figure 3:
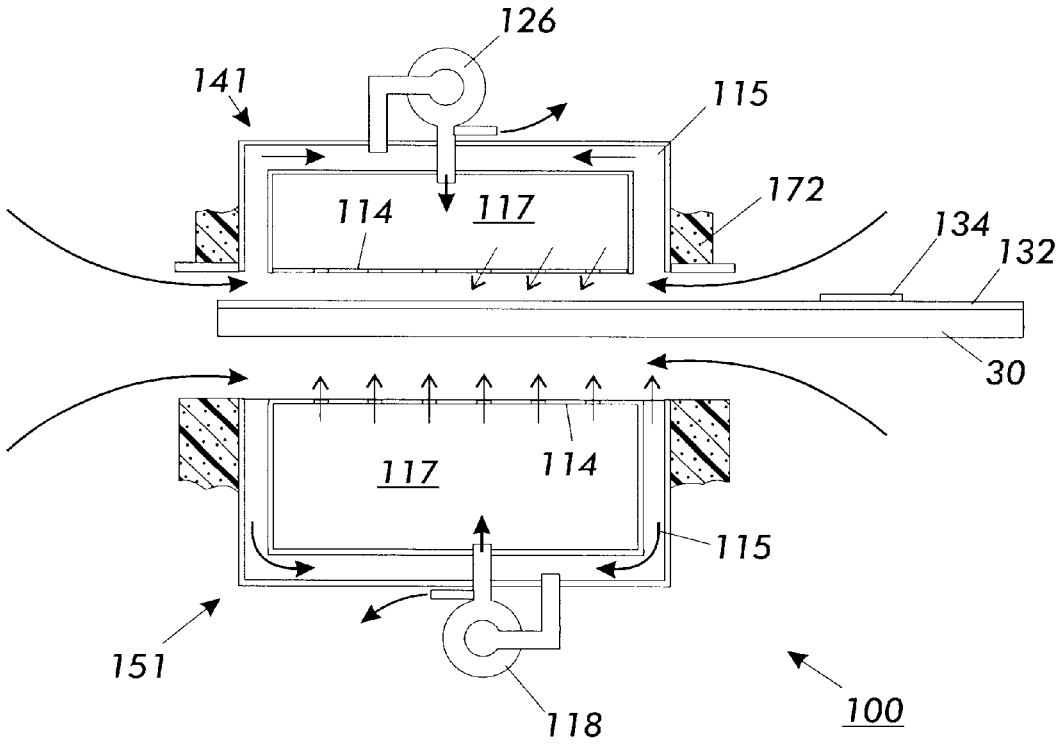
FIG. 3 is a schematic side view of a third embodiment of a system for drying liquid ink according to this invention.

FIG. 3 shows a third exemplary embodiment using front and back side air impingement plates 114 similar to those shown in FIGS. 1 and 2. This embodiment has an upper dryer 141 and a lower dryer 151. As shown, each dryer 141 and 151 has the air impingement plate 114 facing the recording medium and has an air impingement plate 112 facing the respective heater plates 110. In lower dryer 151, the gap 122 between the back side of the printed image bearing surface of recording medium 132 and the impingement plate 114 is shown constant but it can either have a graduated slope as shown in the exemplary embodiment of FIG. 2 or it can be substantially constant, as shown in the exemplary embodiment of FIG. 1. In upper dryer 141, the air impingement plate 114 is shown as being relatively parallel with constant gap to the platen 130. The platen 130 in this exemplary embodiment is made of a wire mesh having a relatively high percentage, e.g., 70%, of open area so as to admit air impingement onto the back side of the recording medium 132 from the back side impingement plate 114 of the back side dryer 151. This illustrative embodiment achieves improved drying uniformity relative to the exemplary embodiments shown in FIGS. 1 and 2, as well as relatively reduced drying cycle times and drying air temperatures. However, this system is larger, heavier, and requires relatively more power to operate than those shown in FIGS. 1 and 2.

Figure 8:
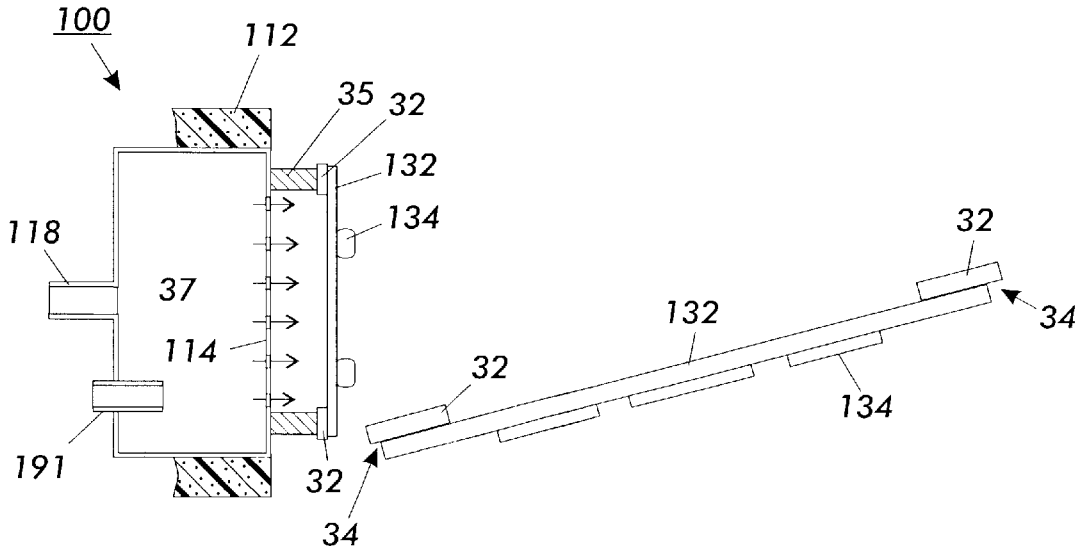
FIG. 8 is a schematic side view of an apparatus used to test a system for drying liquid ink according to this invention.

FIG. 8 shows an exemplary embodiment of dryer 100 constructed and operated to demonstrate the feasibility of the exemplary embodiments shown in FIGS. 1–3, which can be used to dry one recording medium 132 with liquid ink 134 deposited thereon at a time. In this embodiment, steam from a vaporizer is applied to the surface of the recording medium 132 on which liquid ink 134 has been deposited for a short period of time. Then the recording medium is placed against spacers 35 to provide a constant gap 104 so that the back of the recording medium is heated by the moist air which passes through the air impingement plate 114. The moist air is supplied by a steam source (not shown) which injects moist air in the form of steam through opening 191. Heated air is provided through opening 118 into chamber 37 and air jets are formed by impingement plate 114 to impinge on the printed image surface of recording medium 132, which is mounted in an aluminum frame 32, by double backed adhesive tape 34, and the frame 32 is supported by spacers 35 to provide constant gap 104.

A piece of paper 132 bearing ink 134 was attached to an aluminum frame 32. The laminar air flow dryer was omitted and the initial moisture that would have condensed onto the printed ink image 134 was applied quickly (¾ of a second) by applying a cloud of steam generated by a vaporizer. Next, the back side of the inked paper 132, mounted in the frame 32 was manually held 4 mm below the impingement dryer plate 114 over the time of a drying cycle. Immediately thereafter, the dried image was pressed into firm contact with clean paper to subjectively evaluate drying by any ink offset onto the clean paper. The results of these tests confirmed a rapid and improved drying cycle time and enhanced image quality (improved ink optical density, uniformity and image contrast without drying artifacts) for a number of different papers 132. The data shows that for one particular difficult to dry paper, referred to as xerographic "4024" paper, drying was achieved in less than 3 seconds when an air drying temperature of 150° C. was used. Some other papers took up to 6 seconds to dry with an air drying temperature of 190° C.

FIGS. 4 through 7 show some of the results of computer modeling which computes the temperature distribution in the recording medium 132 as well as any evaporation or condensation occurring at the surfaces of the ink 134 and recording medium 132 when dried with this invention. The effects of the flow of recirculating moist air in the dryer 100 are simulated for two cases. In the first case, illustrated in FIGS. 4 and 6, the recirculating air contains 10 percent moisture (by mass) and in the second case, illustrated in FIGS. 5 and 7, the re-circulating air contains 20 percent moisture (by mass). In both cases, the temperature of the air inside the dryer chamber 117 was maintained at about 175° C. The thickness of the liquid ink which was printed by an inkjet printer onto a paper recording medium 132 is plotted vertically in FIGS. 4–7. The motion of the paper recording medium 132 through the dryer 100 is assumed to be continuous at a speed of 12 centimeters per minute (cpm). When the moisture level of the air is higher, i.e., at a 20 percent level, drying of the ink takes a longer drying distance as compared with the case in which the moisture level is lower, i.e., at a 10 percent level.

Figure 4:
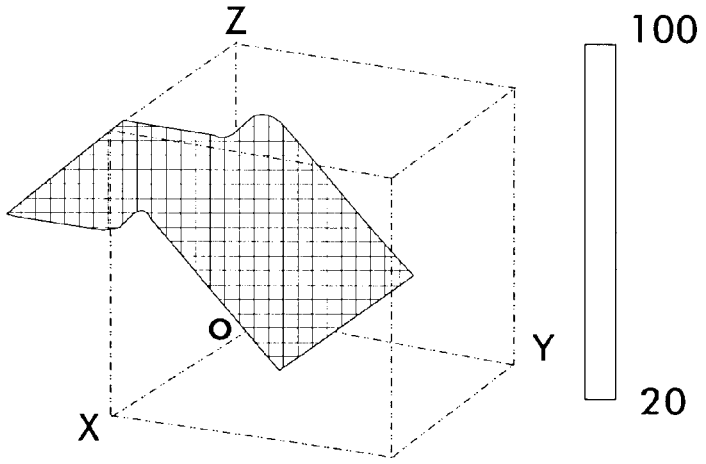
FIG. 4 is a computer generated three-dimensional graph of ink thickness changes of liquid ink on a recording medium that is located partway in a dryer using one exemplary embodiment of the system for drying ink according to this invention, using air with a ten percent moisture content.
Figure 5:
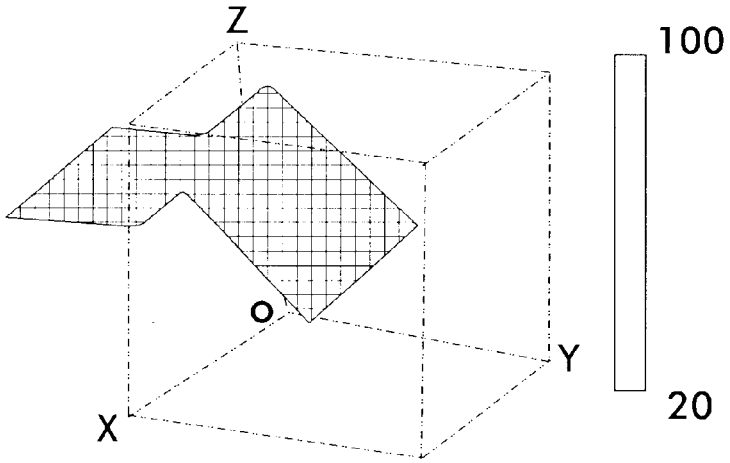
FIG. 5 is a computer generated three-dimensional graph of ink thickness changes of liquid ink on a recording medium that is located partway in a dryer using one exemplary embodiment of the system for drying ink according to this invention, using air with a twenty percent moisture content.
Figure 6:
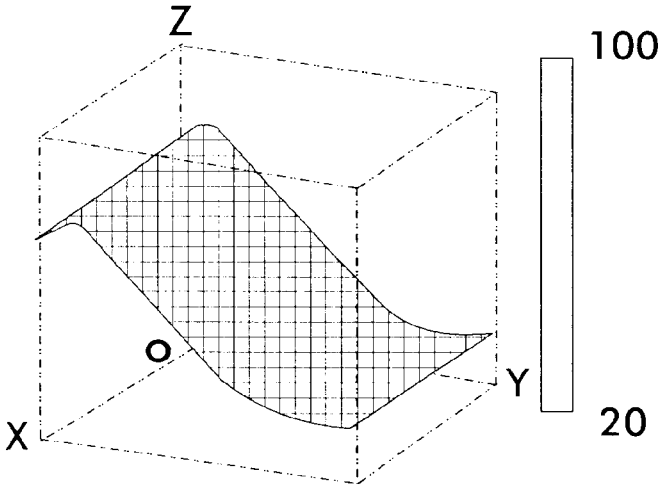
FIG. 6 is a computer generated three-dimensional graph of ink thickness changes of liquid ink on a recording medium at the time the trailing edge of the recording medium enters a dryer using one exemplary embodiment of the systems and methods for drying ink according to this invention, using air with a ten percent moisture content.
Figure 7:
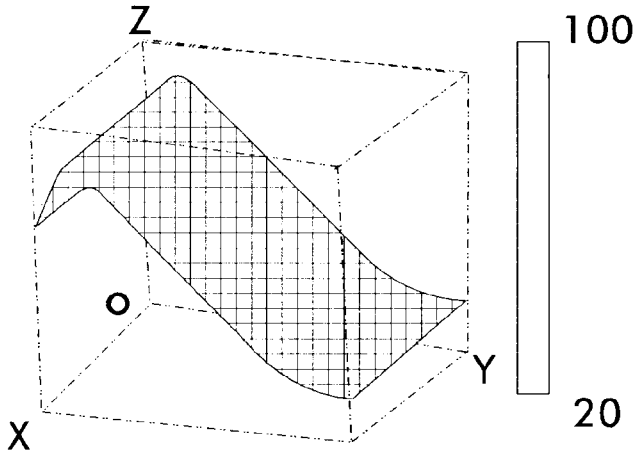
FIG. 7 is a computer generated three-dimensional graph of ink thickness changes of liquid ink on a recording medium at the time the trailing edge of the paper enters a dryer using one exemplary embodiment of the systems and methods for drying ink according to this invention, using air with a twenty percent moisture content.

FIGS. 4 and 5 are shown with the paper only partway into the dryer 100, and FIGS. 6 and 7 show when the trailing edge of the paper enters the dryer. FIGS. 4–7 clearly demonstrate the increase in liquid thickness that occurs in the liquid ink 134 near the entrance of the dryer 100, which appears to be the result of the initial condensation of water vapor from the re-circulating air stream onto the relatively cool paper recording medium 132. Clearly, the higher moisture content of the recirculating air, the greater the initial condensation and the higher the resulting temperature on the top surface of the recording medium 132 on which the liquid ink 134 has been deposited. In each case, the liquid ink 134 is assumed to contain about 24% of non-volatiles and complete evaporation of the condensed water is assumed to occur.

Based on numerous tests conducted at ambient atmospheric pressure with the aforedescribed breadboard system exemplary embodiment of FIG. 1, it was confirmed that this forced moist air drying invention produces acceptable drying and even enhanced quality of inkjet printed images wherein the ink used was a water based, relatively high surface tension and relatively low penetrating ink. The moisture content of the supply papers used in tests conducted by Applicants ranged from about 3% to 11.3% by mass of water.

The types of supply paper used included uncoated and coated (for photographic image) reproduction, including a standard "4024" uncoated paper, which has a reputation for being difficult to dry. The test inkjet image was a 4.25 cm by 20 cm graduated density bar chart using an ink laydown of 5–20 drops per pixel range resulting in a 0.7 to 1.35 optical density range. Each density bar contained 5 drops per pixel of black ink. The aforementioned difficult-to-dry supply papers, which had about a 3% to 9% moisture content, were dried in about 3 seconds. The other uncoated supply papers and the coated supply papers were dry within 6 seconds or less, and most were dry within 3 seconds. A humid drying gas, with approximately 10 percent moisture content (by mass) dried the inkjet printer image on the difficult-to-dry paper in 3 seconds with a 168° C. drying air temperature whereas using dry air at 190° C., it took 6 seconds to dry the image on this difficult-to-dry paper.

A humid drying gas, with approximately 11 percent moisture content (by mass) applied to inkjet printed images on the difficult-to-dry paper produces a dry inkjet printed image with a slightly higher optical density than baseline drying (which is room temperature drying with no forced air) and with a uniform density and no drying artifacts. When using dry non-humidified air in the dryer 100, the optical density of the dried printer image is only slightly less than the optical density achieved with baseline drying and only minor, barely visible drying artifacts appear on the difficult-to-dry paper, but no such artifacts show up on the other papers tested. Also, when testing with a FIG. 2 configuration, both the slow uniform temperature pre-drying section 42 at the feed end of the dryer 100 and the modulated air intensity provided by the sloped impingement plate 114 both contributed to minimize artifacts when using non-humidified air. With the exception of one of the coated supply papers and transparencies, no scorch or other damage occurred to the tested supply papers when they were held within the dryer at 200° C. for 15 minutes, as they might be if there was a paper jam. In the case of the one coated paper, the coating melted and began to flow. Transparencies began to melt and curl but did not adhere to the surfaces of the dryer 100. No paper curling or wrinkling occurred even when the humidified air was used.

Although the mechanisms involved in achieving the improved results set forth above are not completely understood, the following explanation of such mechanisms is presented not by way of limitation but in the interest of the advancement of the understanding of possible causes for these improved results.

It appears that the improved drying and inkjet printed image quality may be due to the occurrence of initial moisture condensation on the ink 134 and printed image recording medium 132, e.g., paper, of approximately 0.03 milligrams per square centimeter which occurs in roughly 0.01 second, raising the temperature of the ink and recording medium surface temperature to about 58° F. above their temperature of about 72° F. to 130° F. when they enter the dryer 100. This moisture condensation onto the surfaces of liquid ink 134 and recording medium 132 may dilute the ink and uniformly increase the ink 134 and recording medium 132 surface temperature. As a result, the viscosity and effective surface tension of the ink 134 may be lowered, thereby decreasing the ink-to-paper wetting contact angle causing ink drops to spread and coalesce, resulting in a more uniform and denser image. The improved wetting and lower viscosity may allow some ink 134 penetration into the recording medium 132 (e.g., paper) on uncoated recording mediums, such as the aforementioned difficult-to-dry paper "4024".

The more uniform temperature produced by condensation acts to prevent surface tension and viscosity gradients in the ink 134, resulting in a more uniform inkflow process over the entire printed image area rather than a localized spot flow, which may occur directly under air impingement jets. These mechanisms also appear to produce a thinner printed ink layer which is easier to dry than individual droplets. Moreover, it appears that the water dilution of the ink helps to prevent formation of a skin on the drying ink so that a more ideal type free-surface drying process occurs rather than a diffusion-type drying process through a "skin-over" layer of ink 134. This, in turn, results in more uniform drying which results in formation of fewer artifacts.

While this invention has been described in conjunction with the exemplary embodiments outlined above, it is evident that many alternatives, modifications and variations will be apparent to those of ordinary skill in the art. Accordingly, the exemplary embodiments of the invention, as set forth above, are intended to be illustrative, and not limiting. Various changes may be made without departing from the spirit and scope of the invention.

What is claimed is:

1. A method of improving the appearance of a printed ink image on a recording medium comprising:

impinging warm, moist air onto the printed ink image before the ink has dried;

condensing water vapor from the warm moist air onto the printed ink image before the ink has dried;

drying the printed ink image on the recording medium using the warm moist air.

2. The method of claim 1, further comprising re-circulating the air onto the printed ink image.

3. The method of claim 1, further comprising adjusting the temperature of the air.

4. The method of claim 1, further comprising adjusting the moisture content of the air.

5. The method of claim 1, further comprising adjusting the temperature by impinging the air onto a heating element.

6. A dryer for enhancing the appearance of a printed ink image on a recording medium, comprising:

an air input, an air output, a recording medium inlet and a recording medium outlet;

apparatus to ensure that the air within the dryer has enough moisture so that the dew point temperature of the air is above the temperature of the recording medium and ink printed thereon at the recording medium inlet;

air impingement apparatus to impinge warm moist air onto the recording medium and printed ink image before the ink has dried to initially condense water vapor from the moist air onto the ink and recording medium and, subsequently, to uniformly dry the ink on the recording medium.

7. A dryer according to claim 6, wherein the condensation takes place near the recording medium inlet.

8. The dryer of claim 6, further comprising one or more air impingement elements to form jets of air to impinge on the recording medium and printed ink image at selected and controlled velocity or intensity.

9. The dryer of claim 6, further comprising a heater for heating the air in the dryer.

10. The dryer of claim 8, further comprising an apparatus to move the recording medium relative to the drying oven along a recording medium path at least part of which one impingement element is a plate which lies within a plane, and wherein at least one impingement element is a plate lying in a plane which is tilted with respect to the plane of the path of the recording medium.

11. The dryer of claim 10, wherein the tilted plate is separated further from the recording medium near the recording medium inlet than near the recording medium outlet.

12. The dryer of claim 8, wherein the air impingement element is in the form of a plate and openings in the form of holes or slits.

13. The dryer of claim 12, wherein the edges of the holes or slits are rounded on at least one side of the plate.

14. The dryer of claim 6, further comprising air recirculation ductwork, fan and air supply chamber.

15. The dryer of claim 6, comprising an air supply chamber including one or more air jet forming elements.

16. The dryer of claim 15, further comprising an air recirculation chamber surrounding the air jet forming chamber.

17. The dryer of claim 15, further comprising a heating element located in the air jet forming chamber onto which the dryer air supply is impinged to increase heat transfer and reduce the temperature and physical size of the heater.

18. The dryer of claim 6, further comprising a platen to support the recording medium.

19. The dryer of claim 18, wherein the platen is porous.

20. The dryer of claim 19, wherein the platen is in the form of a screen.

21. The dryer of claim 6, wherein the air impingement apparatus includes a portion which is located in a position to also impinge in a turbulent flow pattern onto the back side of the recording medium as well as in a laminar flow pattern onto the front side.

22. The dryer of claim 6, further comprising an element to re-circulate air in the dryer and onto the recording medium.

23. The dryer of claim 6, wherein the air re-circulation element is a fan.

24. A dryer for drying printed ink deposited on a recording medium, comprising:

a first dryer section with a laminar flow of air to impinge on the recording medium;

a second dryer section with a turbulent flow of air to impinge on the recording medium;

an apparatus to convey the recording medium with the printed ink to the first dryer section and then to the second dryer section.

25. The dryer of claim 24, further comprising apparatus which graduates the intensity of the turbulent flow of air so that it is lower adjacent the first location and higher away from the first location.

26. The dryer of claim 25, wherein the intensity graduating apparatus includes an air impingement plate variably spaced from the recording medium.

27. The method of claim 1, wherein the drying is performed continuously and rapidly.

28. The dryer of claim 24, further comprising:

an air circulation fan having a motor located in the air flowing in the dryer.

29. The dryer of claim 24, further comprising an air circulation fan having a motor not located in the air flowing in the dryer.

30. The dryer of claim 24, further comprising:

thermal insulation located adjacent to the dryer.

31. The dryer of claim 6, wherein the air impingement apparatus uniformly dries the ink on the recording medium.

32. The dryer of claim 6, wherein the air impingement apparatus includes a fan and further includes a source of steam vapor to provide moisture to the air in the dryer.

33. The dryer of claim 6, further including a driver to oscillate the air impingement apparatus in an orbital plane relative to the recording medium.

34. The dryer of claim 6, further including a driver to oscillate the air impingement apparatus laterally relative to the recording medium.

35. The dryer of claim 6, wherein the impingement apparatus includes a plate with holes to form air jets, and the volume of the dryer and the impingement plate hole size and pattern comprise a low-pass sound filter to reduce acoustic noise in the dryer.

36. The method of claim 1, wherein the drying is done continuously and at a rate equal to the feed rate of the recording medium to the dryer.

37. The method of claim 1, further comprising:

exhausting the warm moist air from the dryer;

removing water from the exhausted air to reduce its humidity;

filtering the exhausted air to remove contaminates; and returning the filtered less humid air to the dryer.

38. The dryer of claim 6, in which the dryer is constructed of materials including metals, plastics, and composites.

39. The dryer of claim 24, wherein the dryer sections are made of materials of the group consisting of metals, plastics and composites.

40. The method of claim 1, wherein the ink image is spread with a substantially uniform thickness, the ink image is relatively thin, the tendency to form an ink skin-over layer is substantially reduced.

41. The method of claim 1, further comprising actively drying the ink at a rate equal to the rate at which the ink image is printed.

42. The apparatus of claim 6, further comprising:

a dryer air exhaust to remove air from the dryer;

a moisture condenser and a contaminate removal filter to dry and filter the removed air; and a vent to return the removed air to the dryer environment.

43. A dryer for enhancing the appearance of a printed ink image on a recording medium, comprising:

an air input, an air output, a recording medium inlet and a recording medium outlet;

apparatus to ensure that the air within the dryer has enough moisture so that the dew point temperature of the air is above the temperature of the recording medium and ink printed thereon at the recording medium inlet;

air impingement apparatus to impinge warm moist air onto the recording medium and printed ink image before the ink has dried to initially condense water vapor from the moist air onto the ink and recording medium and, subsequently, to uniformly dry the ink on the recording medium;

a first dryer section with a laminar flow of air to impinge on the recording medium;

a second dryer section with a turbulent flow of air to impinge on the recording medium; and an apparatus to convey the recording medium with the printed ink to the first dryer section and then to the second dryer section.

* * * * *